US008992006B2

(12) United States Patent
Ito et al.

(10) Patent No.: US 8,992,006 B2
(45) Date of Patent: Mar. 31, 2015

(54) IMAGE FORMING APPARATUS CONFIGURED FOR BI-DIRECTIONAL FEEDING OF MEDIUM

(71) Applicants: Yoichi Ito, Tokyo (JP); Mikio Ohashi, Kanagawa (JP); Fumitaka Kikkawa, Kanagawa (JP); Naoki Saitoh, Kanagawa (JP); Soyoung Park, Kanagawa (JP); Yoshinori Uchino, Kanagawa (JP)

(72) Inventors: Yoichi Ito, Tokyo (JP); Mikio Ohashi, Kanagawa (JP); Fumitaka Kikkawa, Kanagawa (JP); Naoki Saitoh, Kanagawa (JP); Soyoung Park, Kanagawa (JP); Yoshinori Uchino, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 14/026,000

(22) Filed: Sep. 13, 2013

(65) Prior Publication Data

US 2014/0078231 A1 Mar. 20, 2014

(30) Foreign Application Priority Data

Sep. 18, 2012 (JP) ..... 2012-204855
Jun. 1, 2013 (JP) ..... 2013-116539

(51) Int. Cl.

| | |
|---|---|
| ***B41J 2/01*** | (2006.01) |
| ***B41J 13/036*** | (2006.01) |
| ***B41J 3/54*** | (2006.01) |
| ***B41J 13/00*** | (2006.01) |

(52) U.S. Cl.

CPC *B41J 13/036* (2013.01); *B41J 3/54* (2013.01); *B41J 13/0045* (2013.01)

USPC ..... 347/104; 347/101; 347/108

(58) Field of Classification Search

USPC ..... 347/104, 101

See application file for complete search history.

(56) References Cited

U.S. PATENT DOCUMENTS

| | | | | |
|---|---|---|---|---|
| 6,299,365 | B1 * | 10/2001 | Harris et al. | 400/188 |
| 7,731,436 | B2 * | 6/2010 | Lee et al. | 400/188 |
| 8,419,156 | B2 | 4/2013 | Ito et al. | |
| 8,491,090 | B2 | 7/2013 | Park | |
| 8,500,240 | B2 | 8/2013 | Matsubara et al. | |
| 2010/0110134 | A1 * | 5/2010 | Ohmura et al. | 347/15 |
| 2012/0056933 | A1 | 3/2012 | Tanaka et al. | |
| 2012/0062648 | A1 | 3/2012 | Tanaka et al. | |
| 2012/0081487 | A1 | 4/2012 | Tanaka et al. | |
| 2012/0113180 | A1 | 5/2012 | Tanaka et al. | |
| 2012/0113204 | A1 * | 5/2012 | Tanaka et al. | 347/104 |
| 2012/0133706 | A1 | 5/2012 | Park | |
| 2012/0133707 | A1 | 5/2012 | Kikkawa et al. | |
| 2012/0320125 | A1 | 12/2012 | Katoh et al. | |
| 2013/0020753 | A1 | 1/2013 | Ito | |
| 2013/0182036 | A1 | 7/2013 | Park | |

FOREIGN PATENT DOCUMENTS

| | | |
|---|---|---|
| JP | 03-042425 | 2/1991 |
| JP | 04-140166 | 5/1992 |
| JP | 2000-127556 | 5/2000 |

(Continued)

*Primary Examiner* — Henok Legesse
(74) *Attorney, Agent, or Firm* — Cooper & Dunham LLP

(57) ABSTRACT

An image forming apparatus includes an image forming unit forming an image on a recording medium; and a feeding unit feeding the recording medium in first and second directions opposite to each other relative to the image forming unit. Further when the recording medium is supplied from a first or second side of the feeding unit, while the feeding unit feeds the recording medium in the first or second feeding direction, the image forming unit forms an image on the recording medium, and the feeding unit further feeds the recording medium to the second or first side, respectively, of the feeding unit.

11 Claims, 18 Drawing Sheets

(56) References Cited

FOREIGN PATENT DOCUMENTS

| | | |
|---|---|---|
| JP | 2001-180023 | 7/2001 |
| JP | 2002-060117 | 2/2002 |
| JP | 2003-159784 | 6/2003 |
| JP | 2004-167802 | 6/2004 |
| JP | 2009-242032 | 10/2009 |
| JP | 2012-116055 | 6/2012 |
| JP | 4992793 | 8/2012 |

* cited by examiner

IMAGE FORMING APPARATUS CONFIGURED FOR BI-DIRECTIONAL FEEDING OF MEDIUM

CROSS-REFERENCE TO RELATED APPLICATIONS

The present application is based on and claims the benefit of priority under 35 U.S.C §119 of Japanese Patent Application Nos. 2012-204855 filed Sep. 18, 2012 and 2013-116539 filed Jun. 1, 2013, the entire contents of which are hereby incorporated herein by reference.

BACKGROUND OF THE INVENTION

1. Field of the Invention

The present invention relates to an image forming apparatus.

2. Description of the Related Art

As an image forming apparatus such as a printer, a facsimile machine, a copier, a plotter, a multi-functional peripheral (MFP) thereof or the like, more specifically, as an image forming apparatus employing a liquid-discharge recording method using a recording head ejecting ink droplets or the like, an inkjet recording apparatus and the like have been popular.

As an image forming apparatus in related art, there has been known an apparatus in which the recording heads are arranged in a manner that ink droplets discharged are ejected in the horizontal direction. The feeding unit to feed the recording sheet from the sheet supplying unit in the vertical (upward) direction, so that an image is formed by the recording heads on the recording sheet feeding the vertical (upward) direction.

The recording sheet on which the image is formed is discharged to the sheet discharge unit disposed on the upper side of the apparatus main body. In double-sided printing, the discharged recording sheet is returned on the upstream side of the feeding unit, so that the recording sheet is further fed in the vertical (upward) direction and an image is formed on the opposite side where the previous image has been formed. The double-side printed recording sheet is discharged to the sheet discharge unit (see, for example, Japanese Laid-open Patent Publication No. 2012-106055).

SUMMARY OF THE INVENTION

According to an aspect of the present invention, an image forming apparatus include an image forming unit forming an image on a recording medium; and a feeding unit feeding the recording medium facing the image forming unit in a first feeding direction relative to the image forming unit and a second feeding direction opposite to the first feeding direction.

Further, when the recording medium is supplied from a first side of the feeding unit, while the feeding unit feeds the recording medium in the first feeding direction, the image forming unit forms an image on the recording medium, and the feeding unit further feeds the recording medium to a second side of the feeding unit, the second side being opposite to the first side relative to the feeding unit, and when the recording medium is supplied from the second side of the feeding unit, while the feeding unit feeds the recording medium in the second feeding direction, the image forming unit forms an image on the recording medium, and the feeding unit further feeds the recording medium to the first side of the feeding unit.

BRIEF DESCRIPTION OF THE DRAWINGS

Other objects, features, and advantages of the present invention will become more apparent from the following description when read in conjunction with the accompanying drawings, in which.

DETAILED DESCRIPTION OF THE PREFERRED EMBODIMENTS

In the image forming apparatus in the related art, the feeding direction of the recording medium on which an image is formed in the image forming process is always one direction. Namely, the image is formed while the recording medium is fed from the sheet supplying side to the sheet discharging side.

Due to this limitation, the sheet supplying position and the sheet discharging position are fixed; thereby limiting the degree of freedom on how to layout the apparatus.

With such a configuration, it may be difficult to freely install the apparatus to fit the installation space. Further, it may be difficult to add a device for adding an expanded function to meet the user's request.

The present invention is made in light of the problems and may provide an image forming apparatus whose sheet supplying side and sheet discharging side are functionally replaceable, so that a degree of freedom in installation manners and additional function setting may be enhanced.

In the following, embodiments of the present invention are described with the accompanying drawings.

Figure 1:
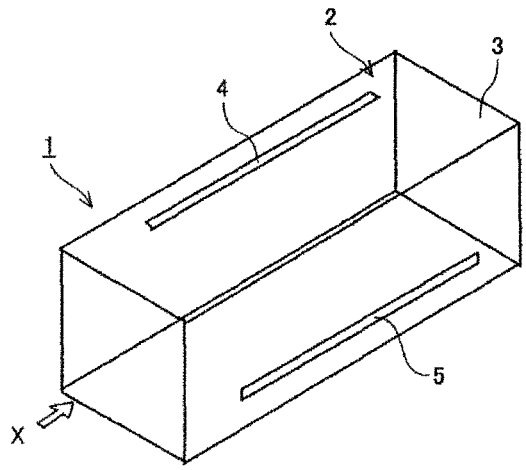
FIG. 1 is an external perspective view of an image forming apparatus according to a first embodiment.
Figure 2:
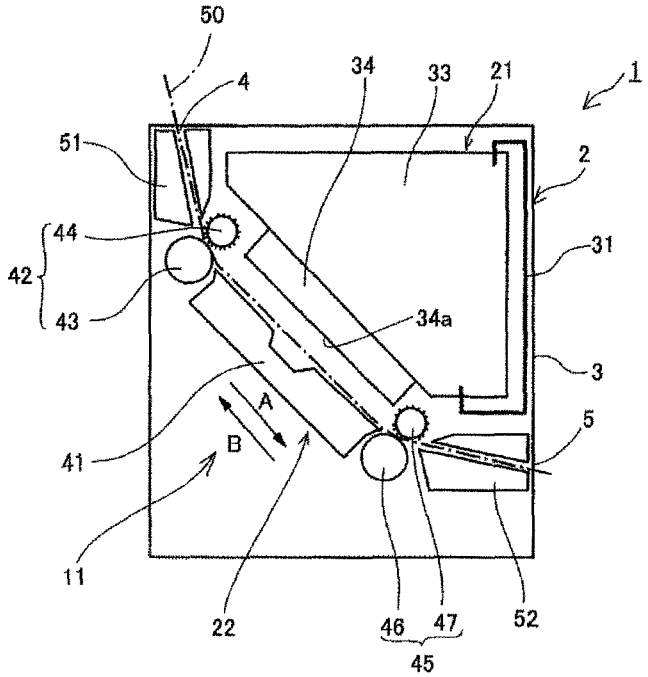
FIG. 2 is a side view of the image forming apparatus when viewed from the X direction of FIG. 1.
Figure 3:
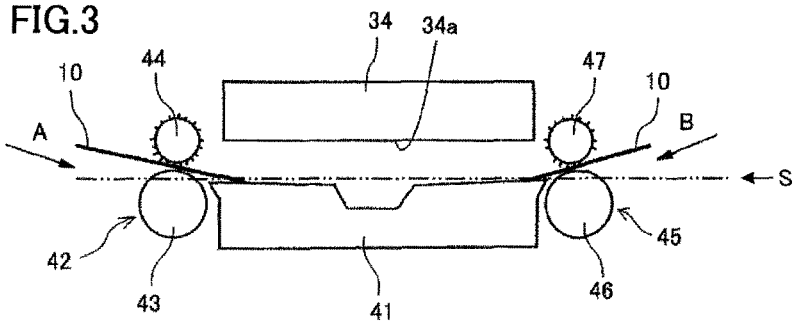
FIG. 3 is a side view of a feeding mechanism part of the image forming apparatus.

First, a first embodiment of the present invention is described with reference to FIGS. 1 through 3. FIG. 1 is an external perspective view of an image forming apparatus. FIG. 2 is a side view of the image forming apparatus when viewed from the X direction of FIG. 1. FIG. 3 is a side view of a feeding mechanism part of the image forming apparatus. The view of FIG. 3 is rotated by approximately 45 degrees relative to the view in FIG. 2.

As shown in FIG. 1, an image forming apparatus 1 includes an apparatus main body 2 and a printing mechanism part 11 that is disposed in the apparatus main body 2. The printing mechanism part 11 performs an image forming process. The apparatus main body 2 includes an outer cover (housing member) 3.

On the upper surface of the outer cover (housing member) 3, an upper opening (first sheet supplying and discharging opening) 4 is formed which is a first medium opening serving as a sheet supplying opening and a sheet discharging opening through which a sheet (i.e., a medium to be recorded) is supplied and discharged.

Similarly, on a side surface of the outer cover (housing member) 3, a side opening (first sheet supplying and discharging opening) 5 is formed which is a second medium opening serving as a sheet supplying opening and a sheet discharging opening through which a sheet is supplied and discharged.

As described above, the upper opening 4 and the side opening 5 are formed on the upper surface and the side surface, respectively, of the apparatus main body 2, and no other opening for supplying or discharging the sheet is formed on any other surfaces of the outer cover (housing member) 3.

Due to this configuration, the image forming apparatus 1 may be installed in a manner that a surface other than the upper surface and the side surface is attached to a (vertical) wall. Even in this manner, an image may be formed by the image forming apparatus 1. Further, the image forming apparatus 1 may be installed in a space-saving manner.

Next, as shown in FIG. 2, the printing mechanism part 11 includes an image forming section 21 that serves as an image forming unit that forms an image on the medium to be recorded ("recording medium"). The printing mechanism part 11 further includes a feeding mechanism part 22 that serves as a feeding unit that feeds the recording medium in a first feeding direction facing the image forming section 21 and in a second feeding direction opposite to the first feeding direction facing the image forming section 21.

The image forming section 21 includes a carriage 33 that is movably supported in the main-scanning direction (i.e. in the direction vertical to the surface of FIG. 2) by a stay 31. The carriage 33 includes a recording head 34 that includes a liquid discharging head for discharging link droplets in various colors such as, for example, yellow (Y), magenta (M), cyan (C), and black (K) colors. Further, as the image forming unit, a recording head other the liquid discharging head may be used.

Here, the recording head 34 is mounted on the carriage 33 in a manner that the recording head 34 is tilted at a predetermined angle (approximately 45 degrees in this example) relative to the horizontal plane so that the liquid droplets discharged from the recording head 34 are directed in an obliquely downward direction.

The feeding mechanism part 22 includes a platen member 41 that guides the feeding of a sheet 10 (see, FIG. 3 and described below) facing the recording head 34. The feeding mechanism part 22 further includes a first feeding rotary body pair 42 on the upper opening 4 side and a second feeding rotary body pair 45 on the side opening 5 side. The first feeding rotary body pair 42 includes an upper feeding roller 43 and a spur 44. The second feeding rotary body pair 45 includes a side feeding roller 46 and a spur 47.

Further, a guide member 51 is arranged between the upper opening 4 and the first feeding rotary body pair 42 so as to guide the sheet 10 therebetween. Also, a guide member 52 is arranged between the side opening 5 and the second feeding rotary body pair 45 so as to guide the sheet 10 therebetween.

In this case, the feeding path (feeding route) 50 of the sheet 10 is depicted in a dashed-dotted line.

Hereinafter, a feeding direction in which the sheet 10 is fed from the upper opening 4 to the side opening 5 is referred to as a "first feeding direction A", and a feeding direction in which the sheet 10 is fed from the side opening 5 to the upper opening 4 is referred to as a "second feeding direction B". Accordingly, the first feeding rotary body pair 42 is disposed on the upstream side of the recording head 34 in the first feeding direction A, and the second feeding rotary body pair 45 is disposed on the upstream side of the recording head 34 in the second feeding direction B.

Further, as shown in FIG. 3 as well, in the direction orthogonal to a nozzle surface 34*a* of the recording head 34 (i.e., in the liquid droplet discharging direction), the upper feeding roller 43 of the first feeding rotary body pair 42 is arranged in a manner that a part of the periphery of the upper feeding roller 43 of the first feeding rotary body pair 42 protrudes beyond the surface level (surface position) of the platen member 41 (the surface position is depicted in the dashed-two dotted line "S" in FIG. 3) on the nozzle surface 34*a* of the recording head 34.

Further, the spur 44 is arranged relative to the periphery of the upper feeding roller 43 in a manner that when the sheet 10 supplied from the upper opening 4 is fed in the first feeding direction A, the sheet 10 is pushed onto the surface platen member 41.

Similarly, in the direction orthogonal to a nozzle surface 34*a* of the recording head 34 (the liquid droplet discharging direction), the side feeding roller 46 of the second feeding rotary body pair 45 is arranged in a manner that a part of the periphery of the side feeding roller 46 of the second feeding rotary body pair 45 protrudes beyond the surface level (surface position) of the platen member 41 on the nozzle surface 34*a* of the recording head 34.

Further, the spur 47 is arranged relative to the periphery of the side feeding roller 46 in a manner that when the sheet 10 supplied from the side opening 5 is fed in the second feeding direction B, the sheet 10 is pushed onto the surface platen member 41.

Due the configuration described above, it is possible that the sheet 10 supplied from the upper opening 4 is fed in the first feeding direction A while the sheet 10 is followed on the surface platen member 41 by the feeding mechanism part 22, so that an image is formed on the sheet 10 by discharging liquid droplets from the recording head 34 of the image forming section 21 and the sheet 10 on which the image is formed is discharged from the side opening 5.

Further, it is also possible that the sheet 10 supplied from the side opening 5 is fed in the second feeding direction B while the sheet 10 is followed on the surface platen member 41 by the feeding mechanism part 22, so that an image is formed on the sheet 10 by discharging liquid droplets from the recording head 34 of the image forming section 21 and the sheet 10 on which the image is formed is discharged from the upper opening 4.

Namely, when the recording medium is supplied from a first side of the feeding unit, the recording medium is fed in the first feeding direction A, an image is formed on the recording medium by the image forming unit, and the recording medium on which the image is formed is fed to a second side, opposite to the first side, of the feeding unit. On the other hand, when the recording medium is supplied from the second side of the feeding unit, the recording medium is fed in the second feeding direction B, an image is formed on the recording medium by the image forming unit, and the recording medium on which the image is formed is fed to the first side of the feeding unit.

By doing this, a sheet supplying side and a sheet discharging side may be changed (interchanged with each other).

Further, as described above, the external form of the apparatus main body 2 is rectangular (cuboid). Due to the external form, a surface other than the upper and side surfaces where the upper opening 4 and the side opening 5, respectively, are formed may be in close contact with a wall or the like. For example, the image forming apparatus 1 (apparatus main body 2) may be installed in a space next to a space where books are on the corner of a desk.

Otherwise, for example, the image forming apparatus 1 (apparatus main body 2) may be installed in a manner that the rear surface side (i.e., the side surface opposite to the other side surface where the side opening 5 is formed) is in close contact with the wall surface of the installation site (space).

Further, in the printing mechanism part 11, the number of rollers for feeding the sheet 10 is reduced so that the flatness of sheet 10 in the position facing the recording head 34 is maintained by the platen member 41. By doing this, the structure of the printing mechanism part 11 is simplified.

In this embodiment, it is described that the recording head 34 is tilted at a predetermined angle (approximately 45 degrees in this example) relative to the horizontal plane. However, it should be noted that the angle of the recording head 34 is not limited to the approximately 45 degrees schematically shown in FIG. 2. Namely, the recording head 34 may be arranged so that the liquid droplet discharging direction corresponds to any direction including the vertical direction and the horizontal direction.

However, in order for the feeding load in the direction from the upper opening 4 (i.e., the first feeding direction A) to be similar to the feeding load in the direction from the side opening 5 (i.e., the second feeding direction B) and that the difference in recording quality between the first feeding direction A and the second feeding direction B is reduced, it is preferable that the angle of the recording head 34 relative to the horizontal plane be set as shown in FIG. 2 Specifically, it is preferable that the above angle be within a range from 30 degrees to 60 degrees.

When the recording head 34 is disposed in a manner that the tilted angle of the recording head 34 is closer to 45 degrees, each of the flexion angles of the sheet 10 from the upper opening 4 to the recording position (i.e., position at the platen member 41) and the flexion angles of the sheet 10 from the side opening 5 to the recording position (position at the platen member 41) may be reduced.

By doing this, the overall sheet feeding load may be reduced, thereby enabling highly-accurate feeding even when a nip part is formed by using a combination of a spur and a roller each having relatively lower feeding power and reducing the number of rollers for feeding the sheet 10. To that end, it is preferable that the tilted angle of the recording head 34 be in a range from 40 degrees to 50 degrees.

Further, in each of the cases where the sheet 10 is fed from the upper opening 4 and the side opening 5, the first and the second feeding rotary body pairs 42 and 45 are arranged so as to press the sheet 10 onto the surface of the platen member 41 to maintain the flatness of sheet 10 in the position facing the recording head 34.

Due to this, even when the printing is performed while any of the header part and the end part of the sheet 10 in the feeding direction is on the platen member 41, it may become possible to prevent the sheet 10 from separating from the surface of the platen member 41, thereby enabling forming an image in high equality.

Figure 4A:
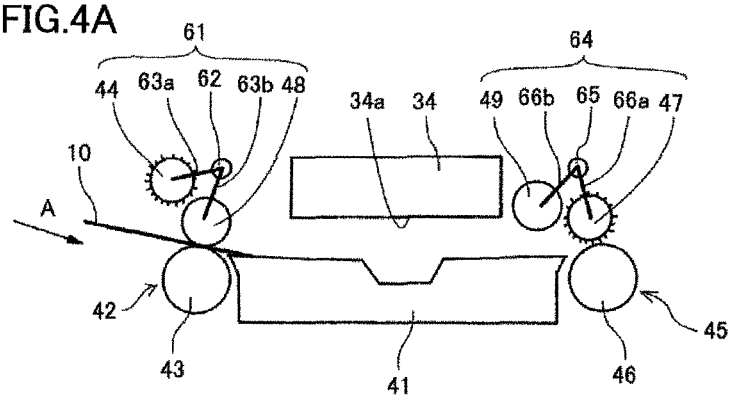
FIGS. 4A and 4B are side views of a feeding mechanism part according to a second embodiment.
Figure 4B:
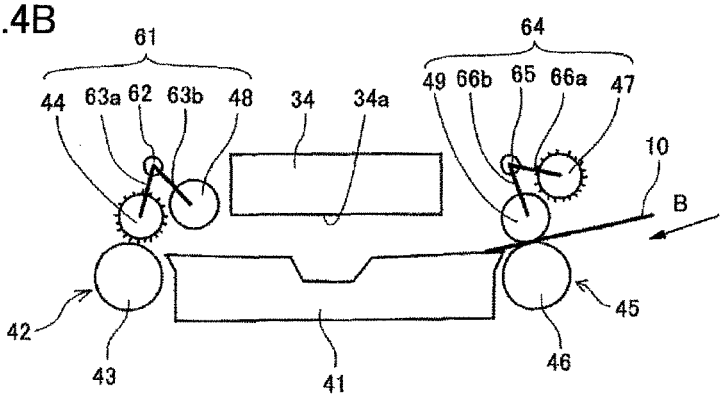

Next, a second embodiment is described with reference to FIGS. 4A and 4B. FIGS. 4A and 4B are side views of a feeding mechanism part according to the second embodiment. In FIGS. 4A and 4B, the direction of the surface of the platen member 41 is substantially parallel to the horizontal direction (i.e., rotated by approximately by 45 degrees relative to the direction of the surface of the platen member 41 in FIG. 2).

Here, a rotary body member 61, that includes a spur 44 and a roller 48, is disposed facing the upper feeding roller 43 of the first feeding rotary body pair 42. The rotary body member 61 includes a rotation axis 62. The spur 44 and the roller 48 are connected to the rotation axis 62 by the arm members 63*a* and 63*b*, respectively, so that the spur 44 and the roller 48 are rotatably supported by the rotation axis 62. The angle between the arm members 63*a* and 63*b* is predetermined.

Similarly, a rotary body member 64, that includes a spur 47 and a roller 49, is disposed facing the side feeding roller 46 of the second feeding rotary body pair 45. The rotary body member 64 includes a rotation axis 65. The spur 47 and the roller 49 are connected to the rotation axis 65 by the arm members 66*a* and 66*b*, respectively, so that the spur 47 and the roller 49 are rotatably supported by the rotation axis 65. The angle between the arm members 66*a* and 66*b* is predetermined.

Further, in this embodiment, when the sheet 10 is fed in the first feeding direction A, as shown in FIG. 4A, the roller 48 of the rotary body member 61 is in contact with the periphery of the upper feeding roller 43 of the first feeding rotary body pair 42 and the spur 47 is in contact with the periphery of the side feeding roller 46 of the second feeding rotary body pair 45.

Similarly, when the sheet 10 is fed in the second feeding direction B, as shown in FIG. 4B, the roller 49 of the rotary body member 64 is in contact with the periphery of the side feeding roller 46 of the second feeding rotary body pair 45 and the spur 44 is in contact with the periphery of the upper feeding roller 43 of the first feeding rotary body pair 42.

By doing this, before an image is formed, a feeding force may be applied to the sheet 10 by the roller pair, and a feeding force applied by the roller pair is greater than the feeding force applied by the combination of the roller and the spur. Further, after the image is formed, by the spur in contact with thee surface of the sheet 10 on which the image is formed, it may become possible to prevent the degradation of the image which may occur due to friction to the formed image on the sheet 10.

Figure 5:
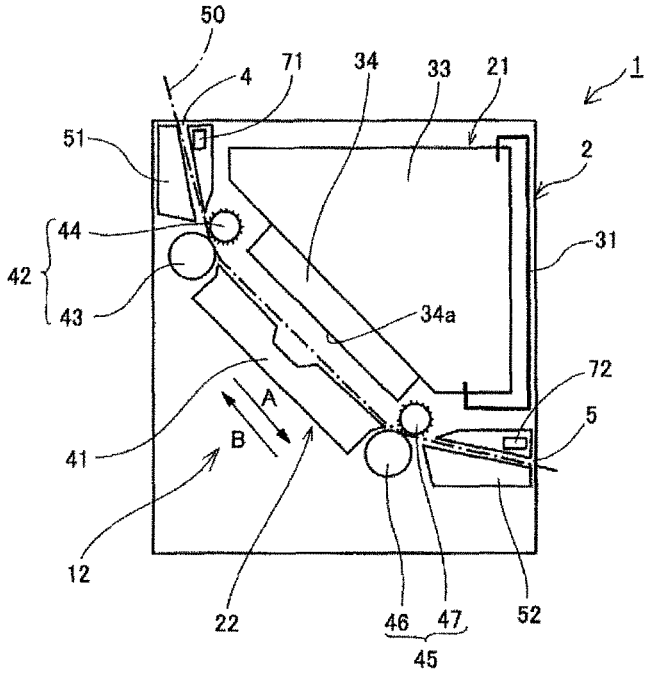
FIG. 5 is a side view similar to FIG. 2 according to a third embodiment.

Next, a third embodiment is described with reference to FIGS. 5 and 6. FIG. 5 is a side view according to the third embodiment similar to FIG. 2.

In this embodiment, the configuration according to this embodiment differs from that in the first embodiment in that sheet sensors 71 and 72 are provided. The sheet sensor 71 detects the sheet 10 near the upper opening 4 as a sheet detecting unit (detecting unit). The sheet sensor 72 detects the sheet 10 near the side opening 5 as the sheet detecting unit.

The sheet sensors 71 and 72 may be, for example, photo sensors. However, any other sensor may be used as the sheet sensors 71 and 72.

Basically, the first feeding direction A or the second feeding direction B is selected by a user input. However, the user may confirm the selected direction based on a signal from the sheet sensor 71 or 72. Namely, although the user input indicates that the first feeding direction A is selected, if the sheet sensor 72 first detects the sheet set, an error message is displayed and the sheet 10 is not fed. This also applies to the case where although the user input indicates that the second feeding direction B is selected, if the sheet sensor 71 first detects the sheet set.

In another example, the detection signals from the sheet sensors 71 and 72 is not used for checking the sheet feeding direction, but may be used for determining the sheet feeding direction. The specific process of determining the sheet feeding direction is described with a flowchart of FIG. 6 in which a printing operation in a manual single-sheet printing.

Figure 6:
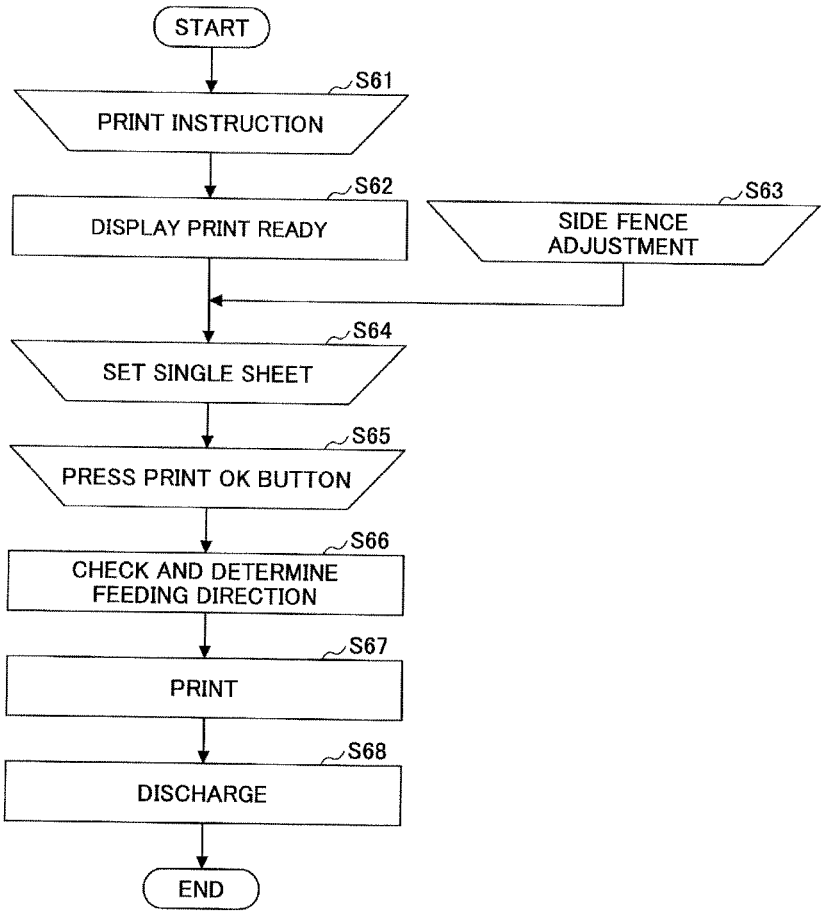
FIG. 6 is a flowchart illustrating a printing operation in a manual single-sheet printing according to the third embodiment.

As shown in FIG. 6, a user instructs printing (step S61). A control section (not shown) of the apparatus main body 2 causes an operation section (not shown) to display a message (sign) indicating that printing is ready (step S62). Then, the user sets (inserts) one sheet 10 through the upper opening 4 or the side opening 5 (step S64), and presses a print OK button on the operation section of the apparatus main body 2 (step S65).

In this case, the position of the sheet in the width direction may be adjusted by side fence adjustment (not shown) (step S63).

Here, the control section of the apparatus main body 2 checks the detection signals from the sheet sensors 71 and 72 and determine whether the sheet 10 is set at the upper opening 4 or the side opening 5 to determine the feeding direction of the sheet 10 (i.e., the driving direction of the feeding mechanism part 22) (step S66).

Then, while the sheet 10 is fed in the determined feeding direction by the feeding mechanism part 22, the recording head 34 is driven to perform a printing process of forming an image on the sheet 10 (step S67). In this case, the sheet 10 is intermittently fed and the carriage 33 is moved in the main-scanning direction to discharge liquid droplets from the recording head 34. By repeating the operation, the image is formed on the sheet 10.

By feeding the sheet 10 while the image is formed, the sheet 10 is further fed in the feeding direction and discharged from the side opening 5 or the upper opening 4 (step S68).

By doing this, when manual printing is performed, even when a user may arbitrarily select either the upper opening 4 or the side opening 5 to set the sheet 10 for printing, the apparatus main body 2 may accept the setting by selectively changing the sheet supplying opening and the sheet discharging opening to print the sheet 10 based on the user's selection.

Further, by using the sheet sensors 71 and 72, paper jamming may be detected. Further, by measuring the distance of the sheet 10 passing through the two sheet sensors 71 and 72, the slipping of the sheet (magnification error) may be corrected. Further, when a sheet supplying unit where plural sheets can be stacked is additionally attached, the rear end part of the sheet is detected, and based on the detected information, the next sheet is fed, so that continuous sheet feeding may be performed.

In the above printing operation flow, the step in checking the pressing of the print OF button may be omitted, or the print OK button may be directly removed. In this case, the sheet sensor 71 or 72 may detect that a sheet is inserted by a user, then the feeding mechanism part 22 is driven to be rotated in the corresponding direction, or after the preparation of printing is completed, the feeding mechanism part 22 is rotated. Further, to facilitate the sheet setting, a mechanism of drawing the sheet that is manually set (e.g., a drawing roller) may be added.

Figure 7:
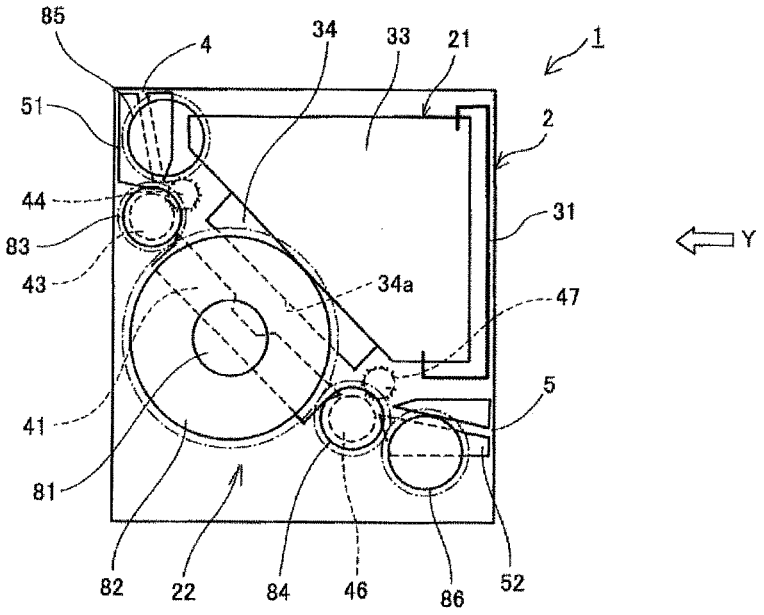
FIG. 7 is a side view similar to FIG. 2 according to a fourth embodiment.
Figure 8:
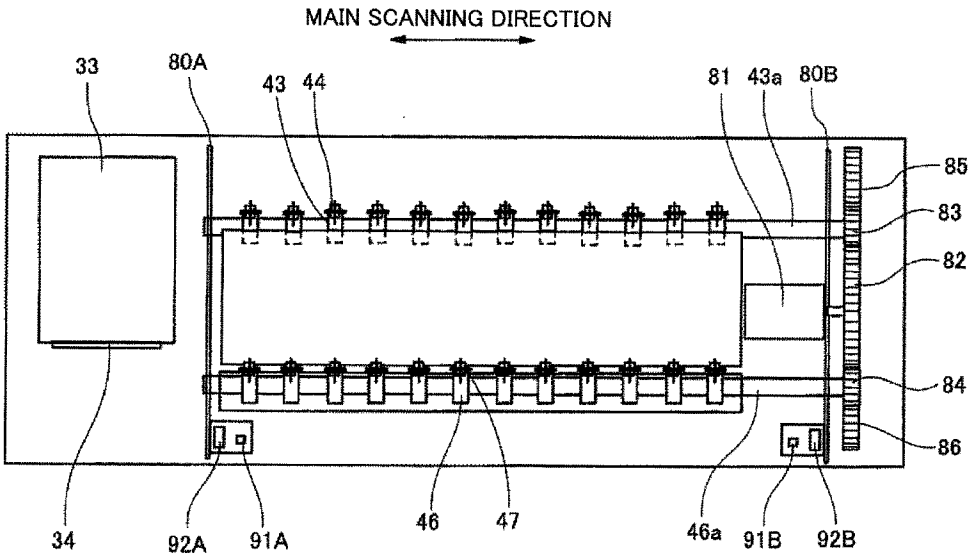
FIG. 8 is a top view of the image forming apparatus when viewed from the Y direction of FIG. 7.

Next, a fourth embodiment is described with reference to FIGS. 7 and 8. FIG. 7 is a side view according to a fourth embodiment similar to FIG. 2. FIG. 8 is a top view of the image forming apparatus when viewed from the Y direction of FIG. 7. Here, in FIG. 7, a side of the exterior of the apparatus main body 2 is assumed to be transparent to view the elements inside the apparatus main body 2.

In this embodiment, each of the upper feeding roller 43 and the side feeding roller 46 of the feeding mechanism part 22 is rotatably supported by a left side plate 80A and a right side plate BOB.

Further, the feeding mechanism part 22 includes a motor 81, a motor gear 82 that rotates by the motor 81, an upper feeding roller gear 83 that is attached to an axle part 43*a* of the upper feeding roller 43 and is in engagement with the motor gear 82, and a side feeding roller gear 84 that is attached to an axle part 46*a* of the side feeding roller 43 and is in engagement with the motor gear 82.

The feeding mechanism part 22 further includes an upper joint gear 85 that is in engagement with the upper feeding roller gear 83 and a side joint gear 86 that is in engagement with the side feeding roller gear 84. Those joint gears 85 and 86 are provided to transmit the feeding driving force to an extension unit that can be attached to the upper opening 4 or the side opening 5 as described below.

Due to the structure of the driving mechanism, the upper feeding roller 43 and the side feeding roller 46 rotate in the same direction by rotating the motor 81.

Further, in this configuration described above, the motor 81 is disposed at the center part and a single reducing motor gear 82 fixed to the motor shaft is used to drive the rotation of the upper feeding roller 43 and the side feeding roller 46. Due to this configuration, the stiffness property of the gear and delay caused by a delaying element (e.g., backlash) may be improved because many gears are not used in this configuration.

By doing this, it becomes possible to commonly control the precise feedback of the feeding rollers and improve the stiffness property of the gear and delay caused by a delaying element (e.g., backlash) because not many gears are used.

Further, in the apparatus main body 2, to attach the extension unit to the apparatus main body 2, a position determination section 91A and a fastening section 92A are formed on the left side plate 80A and a position determination section 91B and a fastening section 92B are formed on the right side plate 80B. Those position determination sections 91A and 91B and the fastening section 92A and 92B are used to as a unit (means) to externally connect the feeding path (feeding route) 50 of the apparatus main body 2.

Here, the position determination sections 91A and 91B and the fastening section 92A and 92B have a hole shape so that when the extension unit has a convex shaped part for position determining and a click (snap fit) for fastening (fixing), the position of the extension unit may be fixed relative to the apparatus main body 2 and the extension unit may be jointed to the apparatus main body 2.

Further, the position determination sections 91A and 91B may have a convex shape and the fastening section 92A and 92B may have a click (snap fit). By doing this, when the extension unit has hole-shaped parts, the extension unit may also be jointed to the apparatus main body 2.

By having the same configuration on the upper opening 4 side, the extension unit may also be jointed to the apparatus main body 2 on the upper side as well.

Figure 9:
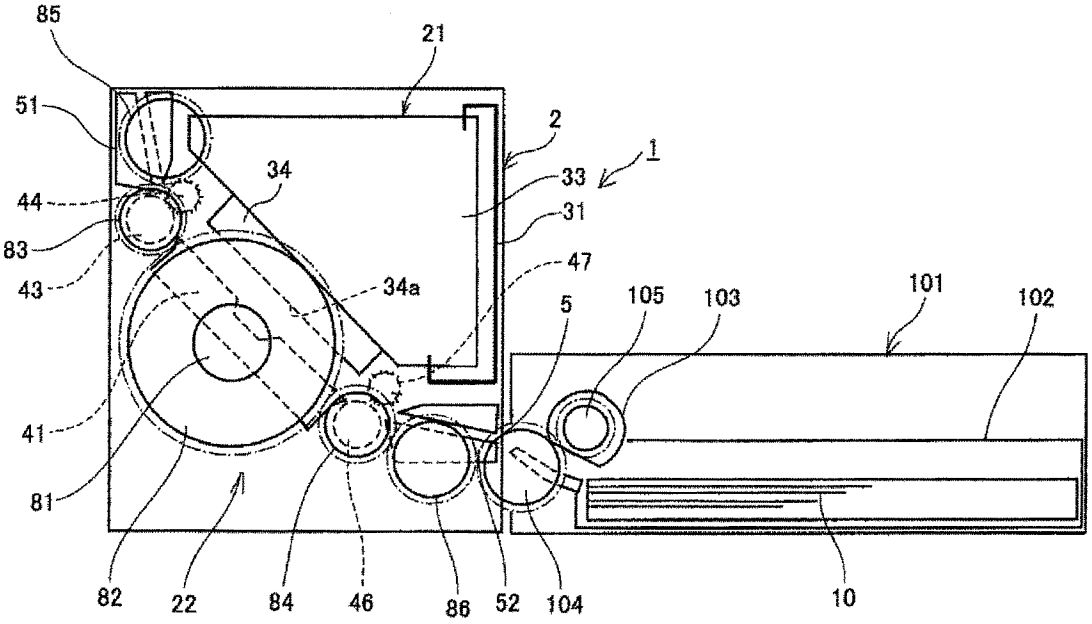
FIG. 9 is a side view of an image forming apparatus according to a fifth embodiment.

Next, a fifth embodiment is described with reference to FIG. 9. FIG. 9 is a side view of an image forming apparatus according to the fifth embodiment.

In this embodiment, a side sheet supplying unit 101 is attached on the side opening 5 side of the apparatus main body 2.

The side sheet supplying unit 101 includes a sheet supplying cassette 102 to stack the sheets 10, a sheet feeding roller 103 that separates and supplies the sheet 10 one by one, a side unit joint gear 104 that is to be in engagement with the side joint gear 86 in an engagement state, and a sheet supplying gear 105 that is fixed to the axle part of the sheet feeding roller 103 and is to be in engagement with the side unit joint gear 104.

By doing this, the driven force may be transmitted from the side joint gear 86 on the apparatus main body 2 side to the side sheet supplying unit 101 so as to feed the sheet 10.

Further, by connecting the side sheet supplying unit 101 that can stack a plurality of sheets 10 to the apparatus main body 2, continuous printing may be performed.

Figure 10:
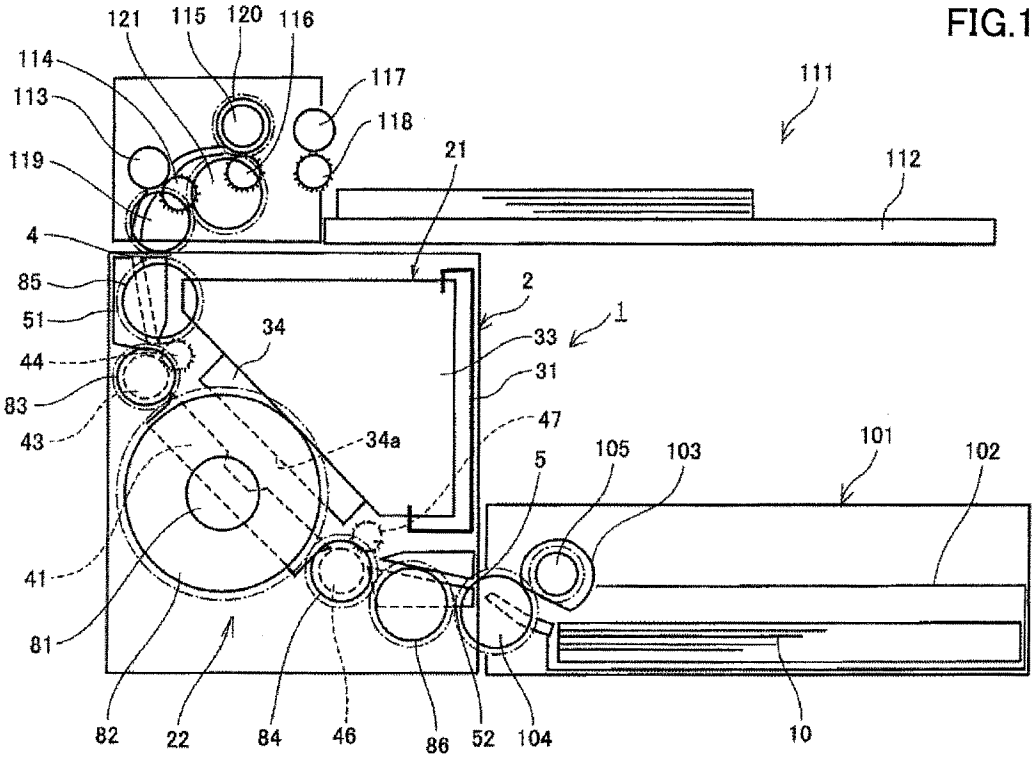
FIG. 10 is a side view of an image forming apparatus according to a sixth embodiment.

Next, a sixth embodiment is described with reference to FIG. 10. FIG. 10 is a side view of an image forming apparatus according to the sixth embodiment.

In this embodiment, in addition to the configuration in the fifth embodiment, an upper sheet discharging unit 111 is attached on the upper opening 4 side of the apparatus main body 2.

The upper sheet discharging unit 111 includes a sheet feeding tray 112 that stocks discharged sheets 10, a roller 113 and a spur 114, a sheet discharging roller 115 and spur 116, and a sheet discharging roller 117 and a spur 118 that feed the sheet 10 discharged from the upper opening 4 of the apparatus main body 2 to the sheet feeding tray 112, an upper unit joint gear 119 that is in engagement with the upper joint gear 85 in an engagement state, a sheet discharging gear 120 provided on the axle part of the sheet discharging roller 115, and a relay gear 121 that is in engagement with the upper unit joint gear 119 and the sheet discharging gear 120.

By having the above configuration, a driving force from the upper joint gear 85 on the apparatus main body 2 side is transmitted to the upper sheet discharging unit 111, so that the sheets 10 can be discharged to the sheet feeding tray 112.

Accordingly, a large number of the sheets 10 after continuous printing may be stacked.

As described above, by making the extension unit attachable, when the side sheet supplying unit 101 and the upper sheet discharging unit 111 are attached to the apparatus main body 2 in a user's house, the apparatus (i.e., the apparatus main body 2 with attached side sheet supplying unit 101 and upper sheet discharging unit 111) can be used as a printer that can print many sheets by continuous printing). In addition, the user can bring out only the apparatus main body 2 so as to use the apparatus (i.e., apparatus main body 2 alone) as a mobile printer for manual single sheet printing.

In the configuration of the mobile printer without any attached sheet feeding tray and sheet discharging tray, if the sheet 10 is inserted into the side opening 5, the sheet 10 discharged from the upper opening 4 cannot be hold. Therefore, for convenience purposes, opposite to the case where the extension units are attached to the apparatus main body 2, it is preferable that the supplied sheet 10 be inserted into the upper opening 4.

Figure 11:
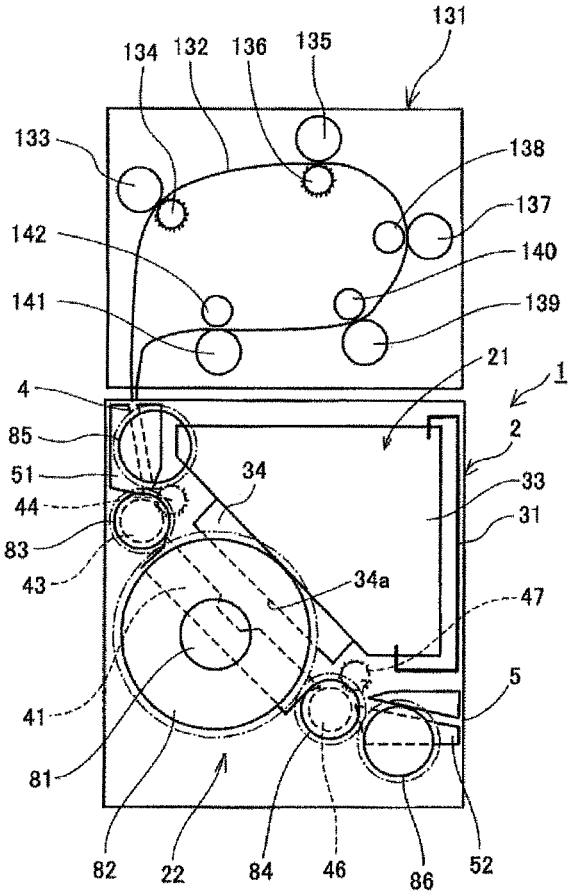
FIG. 11 is a side view of an image forming apparatus according to a seventh embodiment.

Next, a seventh embodiment is described with reference to FIG. 11. FIG. 11 is a side view of an image forming apparatus according to the seventh embodiment.

In this embodiment, as another example where an extension unit is attached (connected), an upper double-sided unit 131 (for double-sided printing) is attached (connected) to the upper opening 4 side of the apparatus main body 2.

As shown in FIG. 11, the upper double-sided unit 131 includes an inversion path 132 to invert the sheet 10 fed from the upper opening 4, a roller 133 and a spur 134, a roller 135 and a spur 136, a roller 137 and a roller 138, a roller 139 and a roller 140, and a roller 141 and a roller 142 to feed the sheet 10.

By having the above configuration, it becomes possible that the sheet 10 fed from the upper opening 4 on the apparatus main body 2 and having one-side surface on which an image is formed is inverted in the upper double-sided unit 131, so that the inverted sheet 10 is supplied through the upper opening 4 again. Then, the inverted sheet 10 is fed in the opposite direction, so that an image is formed on the other side surface of the sheet 10, and the sheet 10 is discharged from the side opening 5.

In a double-sided unit for an image forming apparatus employing a one direction recording method of the related art, the sheet discharged from the printing section is required to be returned back to the sheet supplying side again by bypassing the printing section (i.e., in the case of FIG. 11, the sheet discharged from the upper opening 4 is required to be returned back to the side opening 5 by bypassing the apparatus main body 2). By doing this, however, the distance of the feeding path becomes longer and the size of the apparatus may be increased.

On the other hand, in this embodiment, it is possible to change the sheet feeding direction. Therefore, it is necessary to simply return the sheet 10 back to the upper opening 4 which is the same opening as that from which the sheet is discharged. As a result, it may become possible to attach (install) the upper double-sided unit 131 without substantially increasing the installation area.

As described in the fifth through the seventh embodiments, by simply attaching various extension units to the apparatus main body 2 that is a core elements of the image forming apparatus of the present invention, it may become possible for a user to use the apparatus in various applications.

Figure 12A:
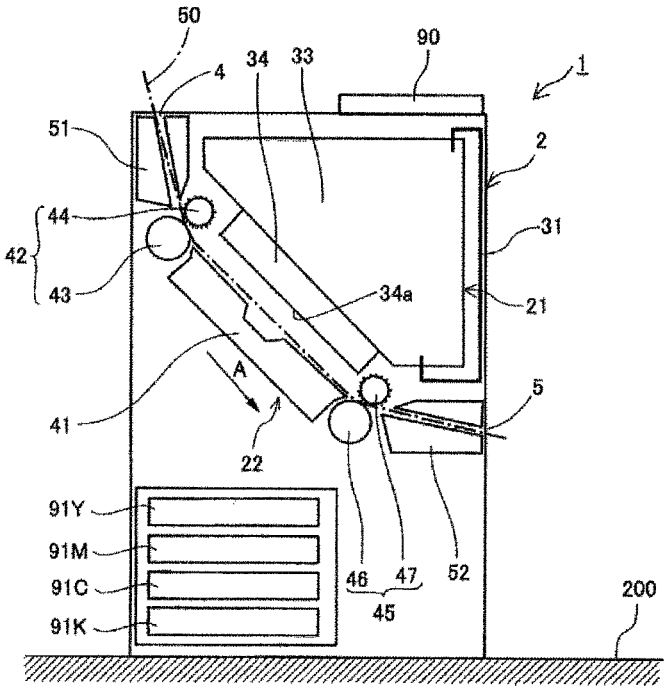
FIGS. 12A and 12B are drawing illustrating the image forming apparatuses that are installed in different manners.
Figure 12B:
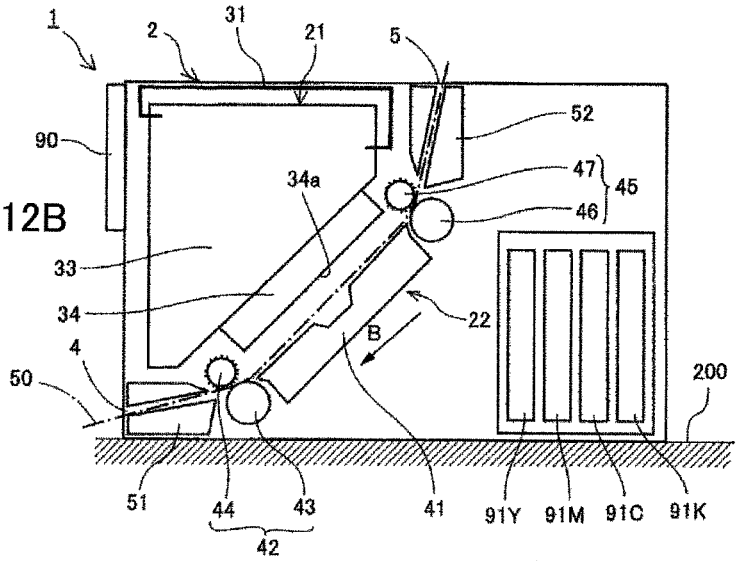

Next, modified examples of the installation modes of the image forming apparatus of the present invention are described with reference to FIGS. 12A and 12B. FIGS. 12A and 12B are drawing illustrating the image forming apparatus installed in different manners.

As illustrated in the above embodiments, the image forming apparatus 1 according to embodiments may be used in an installation mode (e.g., longitudinally installed) where an operation section 90 and the upper opening 4 of the apparatus main body 2 are positioned on the upper side and the side opening 5 is positioned on the lateral side relative to an installation plane 200.

In this case, on the opposite side of the operation section 90 relative to the recording head 34, four-color ink cartridges 91Y, 91M, 91C, and 91K supplying the inks to the recording head 34 are provided mounted. The ink cartridges may be inserted, for example, in the direction orthogonal to the sheet plane of FIG. 12A (i.e., in the side direction when the operation section 90 is viewed in front) to be set to the image forming apparatus 1.

Further, as shown in FIG. 12B, the image forming apparatus 1 according to embodiments may be used in another installation mode (e.g., laterally installed) where the side opening 5 of the apparatus main body 2 is positioned on the upper side and the operation section 90 and the upper opening 4 are positioned on the lateral side relative to the installation plane 200.

Ink discharging performance may greatly differ depending on whether the ink droplets are discharged in the vertical direction or a horizontal direction. However, in the embodiments, the recording head is inclined by approximately 45 degrees relative to the installation plane 200. By doing this, it becomes possible that the ink discharging performance when longitudinally installed is substantially the same as the ink discharging performance when laterally installed.

Further, in the image forming apparatus 1 according to embodiments, the function on the sheet supplying side and the function on the sheet discharging side may be replaced. Therefore, for example, in the installation (use) mode of FIG. 12A, it is possible that the upper opening 4 is used as the sheet supplying side to supply the sheet 10, so that the sheet 10 is fed in the first feeding direction A and an image is formed on the sheet 10. Similarly, in the installation (use) mode of FIG. 12B, it is possible that the side opening 5 is used as the sheet supplying side to supply the sheet 10, so that the sheet 10 is fed in the second feeding direction B and an image is formed on the sheet 10.

Namely, in these modified examples, regardless of the installation (use) modes, in the image forming apparatus 1 according to embodiments, the upper opening 4 may be used as a media opening through which a recording medium is supplied and the side opening 5 may be used as an sheet discharge opening.

By doing this, it becomes possible to freely select an appropriate installation (use) mode (i.e., the longitudinal installation or the lateral installation) depending on, for example, a shape of the installation space. More specifically, for example, when the image forming apparatus 1 is installed on a desk, the image forming apparatus 1 may be longitudinally installed to reduce the occupation space, and when a shelf is placed on the desk, the image forming apparatus 1 may be laterally installed due to the height limitation. In any of the installation modes, the sheet 10 may be supplied from the upper side.

Figure 13:
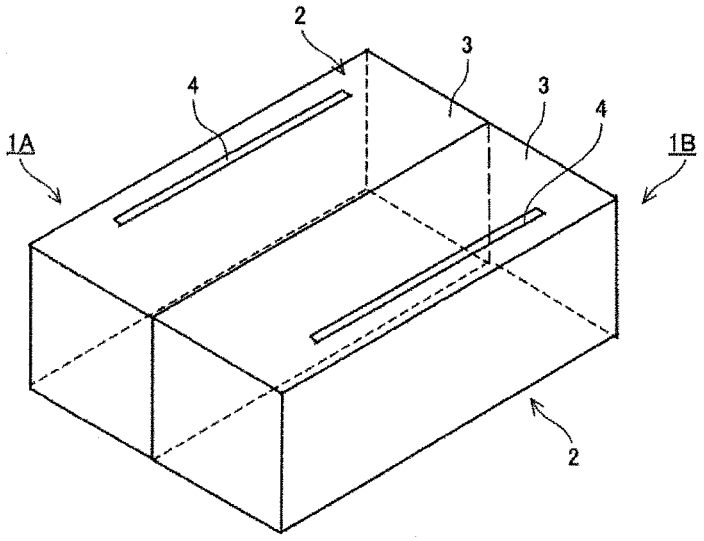
FIG. 13 is an external perspective view of an image forming apparatus according to an eighth embodiment.

Next, an eighth embodiment is described with reference to FIGS. 13 and 14. FIG. 13 is an external perspective view of an image forming apparatus according to the eighth embodiment, and FIG. 14 is a side view of the image forming apparatus according to the eighth embodiment.

Figure 14:
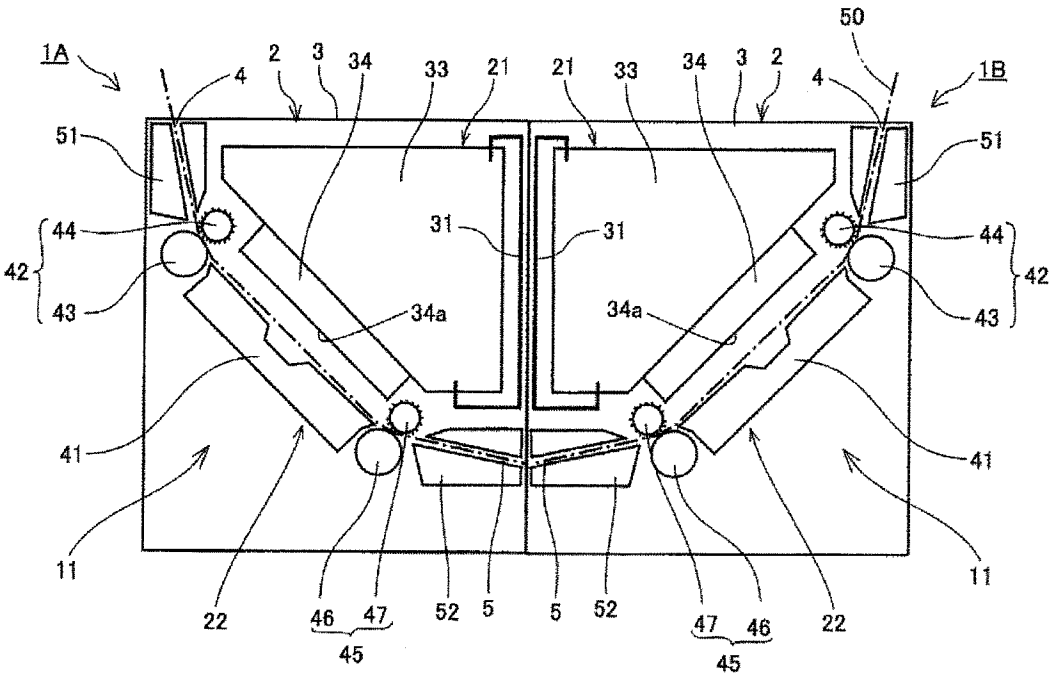
FIG. 14 is a side view of the image forming apparatus according to the eighth embodiment.

In this embodiment, as shown in FIGS. 13 and 14, it is assumed that the image forming apparatus according to above embodiment corresponds to each of image forming units 1A and 1B. Further, those image forming units 1A and 1B are connected in a manner that the side opening 5 of the image forming unit 1A is in contact with the side opening 5 of the image forming unit 1B.

In this case, to ensure that the position of the side opening 5 of the image forming unit 1A fits the position of the side opening 5 of the image forming unit 1B so that the sheet 10 (recording medium) can smoothly be fed from one side opening 5 to another, the image forming units 1A and 1B may be connected with each other by using, for example, position determining bosses and corresponding joint screws.

In the image forming apparatus, the sheet 10 is supplied and discharged using the upper openings 4 of the image forming units 1A and 1B. Further, the image forming apparatus may be installed in a manner that a surface of the image forming apparatus other than the surface where the upper openings 4 are formed is in close contact with a wall surface and used.

According to this embodiment, since plural image forming units are connected to each other, it becomes possible to use the recording heads 34 two or more times. Namely, it becomes possible to virtually increase the number of nozzles to be used for the same surface of the recording medium by ensuring the respective printing positions between the image forming units. By doing this, it may become possible to provide an image forming apparatus having higher productivity than before and stable image forming with an inexpensive configuration.

In the case of this embodiment, two recording heads 34 are used. Therefore, the number of the nozzles may be twice as many as the number of nozzles when a single recording head 34 is used, and the size of the printing area on the recording medium per unit time may be doubled. As a result, it may become possible to double the print productivity while the installation space is saved.

Figure 15:
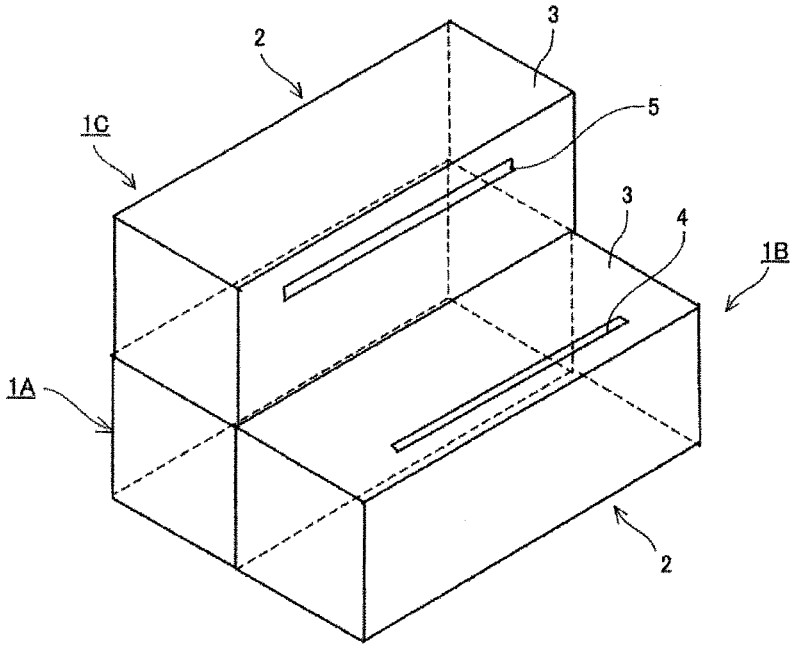
FIG. 15 is an external perspective view of an image forming apparatus according to a ninth embodiment.
Figure 16:
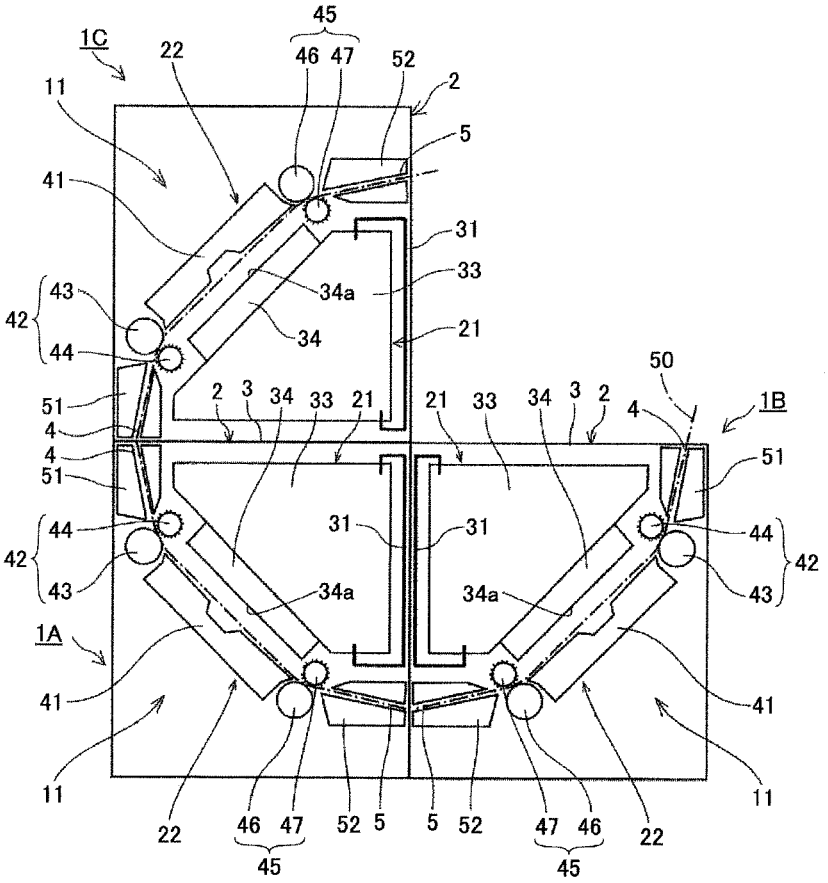
FIG. 16 is a side view of an image forming apparatus according to the ninth embodiment.

Next, a ninth embodiment is described with reference to FIGS. 15 and 16. FIG. 15 is an external perspective view of an image forming apparatus according to the ninth embodiment. FIG. 16 is a side view of the image forming apparatus according to the ninth embodiment.

In this embodiment, three image forming units 1A, 1B, and 1C are connected to configure an image forming apparatus.

Here, the image forming units 1A and 1B are connected to each other in a manner that the side opening 5 of the image forming unit 1A is in contact with (fits) the side opening 5 of the image forming unit 1B. Further, the image forming units 1A and 1C are connected to each other in a manner that the upper opening 4 of the image forming unit 1A is in contact with (fits) the upper opening 4 of the image forming unit 1C.

In this case, to ensure that the position of the side opening 5 of the image forming unit 1A fits the position of the side opening 5 of the image forming unit 1B and the position of the upper opening 4 of the image forming unit 1A fits the position of the upper opening 4 of the image forming unit 1C so that the sheet 10 (recording medium) can smoothly be fed from one side opening 5 to another and from one upper opening 4 to another, the image forming units 1A and 1B and the image forming units 1A and 1C may be connected with each other by using, for example, position determining bosses and corresponding joint screws.

In the image forming apparatus, the sheet 10 is supplied and discharged using the upper opening 4 of the image forming unit 1B and the side opening 5 of the image forming unit 1C. Further, the image forming apparatus may be installed in a manner that a surface of the image forming apparatus other than the surfaces where the upper opening 4 of the image forming unit 1B and the side opening 5 of the image forming unit 1C are formed is in close contact with a wall surface and used.

In the case of this embodiment, three recording heads 34 are used. Therefore, the number of the nozzles may be triple as many as the number of nozzles when a single recording head 34 is used, and the size of the printing area on the recording medium per unit time may be tripled. As a result, it may become possible to triple the print productivity while the installation space is saved.

Figure 17:
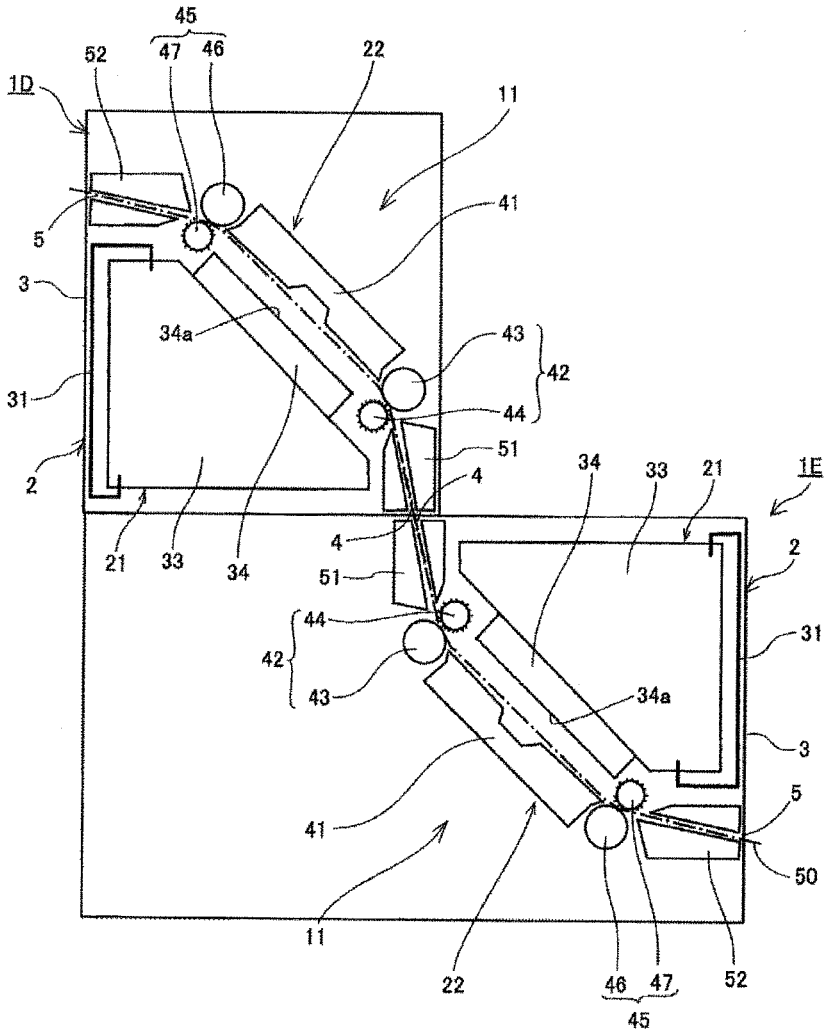
FIG. 17 is a side view of an image forming apparatus according to a tenth embodiment.

Next, a tenth embodiment of the present invention is described with reference to FIG. 17. FIG. 17 is a side view of an image forming apparatus according to the tenth embodiment.

In this embodiment, as shown in FIG. 17, it is assumed that the image forming apparatus according to above embodiment corresponds to each of image forming units 1D and 1E. Further, those image forming units 1D and 1E are connected in a manner that the upper opening 4 of the image forming unit 10 is in contact with the upper opening 4 of the image forming unit 1E.

In this case, to ensure that the position of the upper opening 4 of the image forming unit 1D fits the position of the upper opening 4 of the image forming unit 1E so that the sheet 10 (recording medium) can smoothly be fed from one upper opening 4 to another, the image forming units 1D and 1E may be connected with each other by using, for example, position determining bosses and corresponding joint screws.

In the image forming apparatus, the sheet 10 is supplied and discharged using the side opening 5 of the image forming units 1D and 1E.

Here, the image forming unit 1D and the image forming unit it are arranged (connected) with each other in a positional relationship that images can be formed on different (both-sided) surfaces of the recording medium.

Therefore, for example, the recording head 34 of the image forming unit it forms an image on the rear surface of the recording medium supplied from the side opening 5 of the image forming unit 10, then the recording medium is fed to the image forming unit 1E on the lower side.

Then, the recording head 34 of the image forming unit 1D forms an image on the surface of the recording medium, and the recording medium is discharged from the side opening 5 of the image forming unit 1D.

As described above, double-sided printing may be performed without adding a mechanism (unit) to invert the recording medium.

Further, in this case, plural recording heads are used to perform double-sided printing on a recording sheet. Therefore, the productivity in the double-sided printing may be improved.

Figure 18:
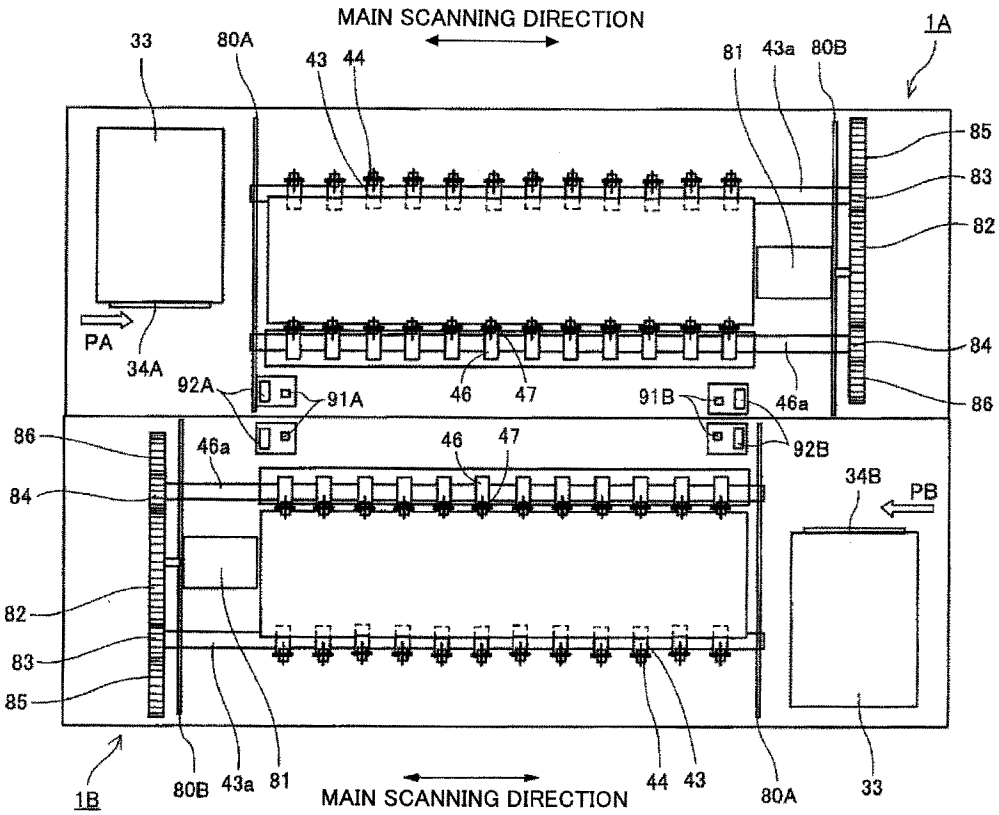
FIG. 18 is a top view of the image forming apparatus according to an eleventh embodiment.

Next, an eleventh embodiment is described with reference to FIG. 18. FIG. 18 is a top view of an image forming apparatus according to the eleventh embodiment. This configuration corresponds to the configuration according to the eighth embodiment.

In this embodiment, as shown in FIG. 18, the home position of the carriage 33 of the image forming unit 1A is disposed on the opposite side of the home position where the carriage 33 of the image forming unit 18 is disposed in the main scanning direction (back and forth moving direction). The printing is performed by moving the carriage 33 of the image forming unit 1A in the printing direction PA and moving the carriage 33 of the image forming unit 1B in the printing direction PB.

By doing this, it may become possible to prevent the occurrence of color differences that may occur when bi-directional printing is performed using one recording head to increase the printing speed.

Figure 19:
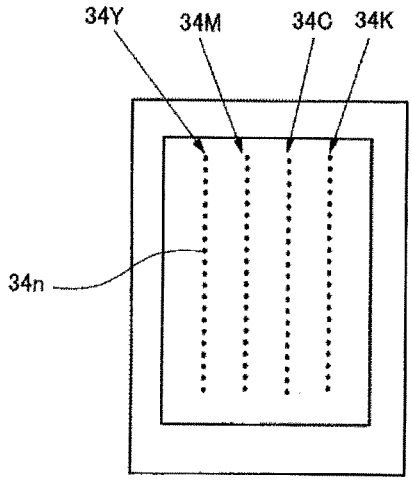
FIG. 19 illustrates an example nozzle arrangement of the recording heads according to the eleventh embodiment.

Namely, for example, as shown in FIG. 19, the recording head 34 includes nozzle lines 34Y, 34M, 34C, and 34K discharging Yellow, Magenta, Cyan, and Black color ink droplets respectively and arranged in a manner that the direction of the nozzle lines are orthogonal to the main scanning direction.

In this case, the recording head 34 is used in both back and forth directions. The order of superimposing colors in the back direction is different from the order of superimposing colors in the forth direction. Due to this difference, color difference may occur.

To resolve the problem, in this embodiment, the printing direction PA in which the image forming unit 1A performs printing and the printing direction PB in which the image forming unit 1B performs printing are opposite to each other.

Figure 20A:
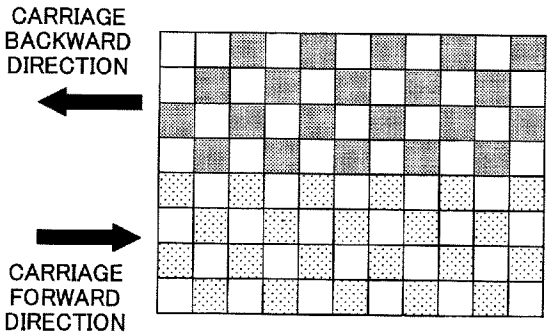
FIGS. 20A and 20B are drawings illustrating images formed by the image forming units according to the eleventh embodiment.

Further, for example, the recording head 34 of the image forming unit 1A is used. In this case, in the movement in the forward direction, the carriage 33 is used to perform multicolor printing by superimposing colors in the order of C ink color and M ink color. Next, in the movement in the backward direction, the carriage 33 is used to perform multicolor printing by superimposing colors in the order of M ink color and C ink color. By doing this, as shown in FIG. 20A, a synthetic color of light blue having a color difference is formed.

Next, the recording head 34 of the image forming unit 1B is used to perform multicolor printing by superimposing colors in the order of C ink color and M ink color in the forward direction on the part where the recording head 34 of the image forming unit 1A is used to perform multicolor printing in the backward direction before.

Also, the recording head 34 of the image forming unit 1B is used to perform multicolor printing by superimposing colors in the order of M ink color and C ink color in the backward direction on the part where the recording head 34 of the image forming unit 1A is used to perform multicolor printing in the forward direction before.

Figure 20B:
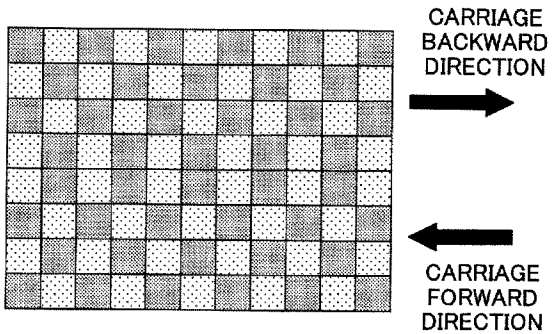

By doing this, as shown in FIG. 20B, a synthetic color of light blue having regular (formal) density is formed.

Therefore, the color difference caused by performing the bi-directional printing including forward and backward printings using a single recording head may be cancelled and prevented. As a result, it may become possible to form a high-quality image without color difference and without reducing the productivity by bi-directional printing with an inexpensive simple configuration.

Further, in the present description, the "sheet" is not limited to a sheet whose material is paper but also any materials including, but not limited to, an OHP, cloth, glass, and substrate, and materials to which ink droplets, other liquid, image forming agent or the like. The "sheet" further includes, but not limited to, materials called a medium to be recorded, a recording medium, a recording paper, a recording sheet and the like. Further, herein, the terms "image forming", "recording", "copying", "imaging", and "printing" have the same meaning.

Further, herein the term "image forming apparatus" refers to an apparatus that performs image forming by applying liquid or image forming agent to a medium such as paper, string, fiber, fabric, leather, metal, plastic, glass, wood, ceramics or the like. Further, the term "image forming" refers to not only a process of applying a meaningful image of characters, figures and the like to a medium but also a process of applying a meaningless image of a pattern or the like to a medium (a process of simply applying liquid droplets or image forming agent to a medium).

Further, herein, unless otherwise limited, the term "ink" is not limited to a material which may called "ink" but is used as a collective name of the liquids including a liquid called a recording liquid, a fixing processing liquid, a liquid and the like and all the liquids that may be used to perform image processing. Also, the term "ink" further includes, for example, a DNA sample, a resist, a pattern material, and resin.

Further, herein, the term "image" is not limited to a two-dimensional image, but includes an image applied to a three-dimensionally formed material and a figure formed by performing three-dimensional modeling on a solid material or the like.

Further, herein, the term "horizontal direction" as the liquid discharging direction refers to a direction other than the vertical direction (i.e., the direction that is inclined upward or downward relative to the horizontal line).

Further, herein, the term "vertical direction" as the sheet feeding direction refers to a direction other than the direction in the horizontal line (i.e., the direction that is inclined upward or downward relative to the vertical line).

Although the invention has been described with respect to specific embodiments for a complete and clear disclosure, the appended claims are not to be thus limited but are to be construed as embodying all modifications and alternative constructions that may occur to one skilled in the art that fairly fall within the basic teaching herein set forth.

What is claimed is:

1. An image forming apparatus comprising:

an apparatus main body;

a first medium opening formed on an upper surface of the apparatus main body;

a second medium opening formed on a side surface of the apparatus main body;

a recording head to discharge liquid droplets to form an image on a recording medium;

a feeder to feed the recording medium facing the recording head in a first feeding direction relative to the recording head and a second feeding direction opposite to the first feeding direction, wherein when the recording medium is supplied from a first side of the feeder via the first medium opening, while the feeder feeds the recording medium in the first feeding direction, the recording head forms an image on the recording medium, and the feeder further feeds the recording medium to a second side of the feeder, the second side being opposite to the first side relative to the recording head, and wherein when the recording medium is supplied from the second side of the feeder via the second medium opening, while the feeder feeds the recording medium in the second feeding direction, the recording head forms an image on the recording medium, and the feeder further feeds the recording medium to the first side of the feeder, wherein the recording head is disposed to discharge the liquid droplets in an obliquely downward direction, and wherein the feeder includes a platen that guides feeding of the recording medium to face the recording head, both in a case of the first feeding direction and in a case of the second feeding direction opposite to the first feeding direction, and the platen is disposed obliquely in accordance with the obliquely downward direction in which the recording head discharges the liquid droplets.

2. The image forming apparatus according to claim 1, wherein the feeder further includes a first feeding rotary body pair disposed on an upstream side of the recording head in the first feeding direction, and a second feeding rotary body pair disposed on an upstream side of the recording head in the second feeding direction, and wherein the first and the second feeding rotary body pairs are disposed at positions so that the first and the second feeding rotary body pairs press the recording medium onto a surface of the platen.

3. The image forming apparatus according to claim 2, wherein one of each of the first and the second feeding rotary body pairs is a spur.

4. The image forming apparatus according to claim 1, wherein when the recording medium is supplied from the first medium opening, the feeder feeds the recording medium in the first feeding direction, the recording head forms an image on the recording medium, and the feeder further feeds the recording medium to discharge the recording medium from the second medium opening, and wherein when the recording medium is supplied from the second medium opening, the feeder feeds the recording medium in the second feeding direction, the recording head forms an image on the recording medium, and the feeder further feeds the recording medium to discharge the recording medium from the first medium opening.

5. The image forming apparatus according to claim 4, further comprising:

a detector disposed at least at one of the first and the second medium openings and configured to detect the recording medium.

6. The image forming apparatus according to claim 1, further comprising:

a connector configured to connect a feeding path, through which the recording medium is fed, to an external unit for the apparatus main body; and a transmitter configured to transmit a feed driving force to feed the recording medium, wherein the connector and the transmitter are disposed at least at one of the first and the second medium openings.

7. A multi-unit image forming apparatus comprising:

two or image forming units, each of the image forming units being configured same as the image forming apparatus according to claim 1, wherein one image forming unit amongst the two or more image forming units is connected to another image forming unit amongst the two or more image forming units in a manner that the first medium opening of the one image forming unit is connected to the second medium opening of said another image forming unit.

8. The image forming apparatus according to claim 7, wherein the image forming units are connected to each other in a positional relationship so that an image is formed on a same surface of the recording medium.

9. The image forming apparatus according to claim 7, wherein the image forming units are connected to each other in a positional relationship so that images are formed on both surfaces of the recording medium.

10. The image forming apparatus according to claim 7, wherein the image forming units include a carriage that is moved in a back and forth direction, and wherein home positions of the image forming units, which are connected to each other, are opposite to each other in the back and forth direction.

11. The image forming apparatus according to claim 1, wherein the recording head is disposed at a tilted angle, relative to a horizontal plane of the upper surface of the apparatus main body, in a range of 40 degrees to 50 degrees, to discharge the liquid droplets in the obliquely downward direction.

* * * * *